United States Patent [19]

Todoroki et al.

[11] 4,314,848

[45] Feb. 9, 1982

[54] SILVER ALLOY FOR A SLIDING CONTACT

[75] Inventors: Tsunehiko Todoroki, Yamatokooriyama; Hyogo Hirohata, Neyagawa, both of Japan

[73] Assignee: Matsushita Electric Industrial Co., Ltd., Osaka, Japan

[21] Appl. No.: 95,791

[22] Filed: Nov. 19, 1979

[30] Foreign Application Priority Data

Nov. 17, 1978 [JP] Japan ..... 53-142674

[51] Int. Cl.[3] ..... C22C 5/08

[52] U.S. Cl. ..... 75/173 C; 200/266; 428/673; 428/929

[58] Field of Search ..... 75/173 R, 173 C, 173 A; 428/673, 929; 200/266

[56] References Cited

U.S. PATENT DOCUMENTS

| | | | |
|---|---|---|---|
| 2,057,604 | 10/1936 | Zickrick | 75/173 A |
| 2,161,253 | 6/1939 | Hensel et al. | 75/173 C |
| 2,200,087 | 5/1940 | Kelly | 428/929 |
| 3,951,872 | 4/1976 | Neely | 428/929 |
| 4,050,930 | 9/1977 | Motoyoshi et al. | 75/173 A |

*Primary Examiner*—Michael L. Lewis

*Attorney, Agent, or Firm*—Wenderoth, Lind & Ponack

[57] ABSTRACT

Silver alloy for sliding contact, containing 2 to 8% Mo, up to 10% Cu, up to 10% Pd and remainder of Ag. This alloy has high wear resistance, low electrical contact-resistance and low mechanical friction. So, when it is used as a sliding contact material, the sliding contact has a long operation life.

4 Claims, 7 Drawing Figures

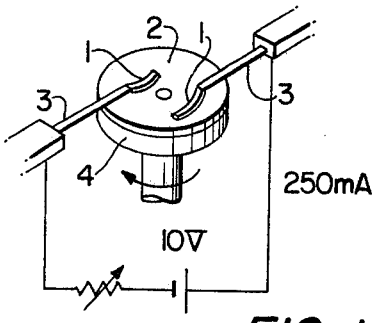
FIG. 1
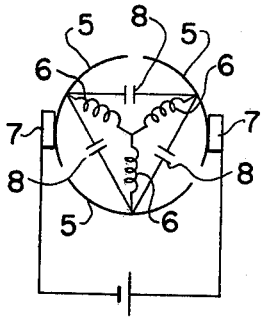
FIG. 3
FIG. 2
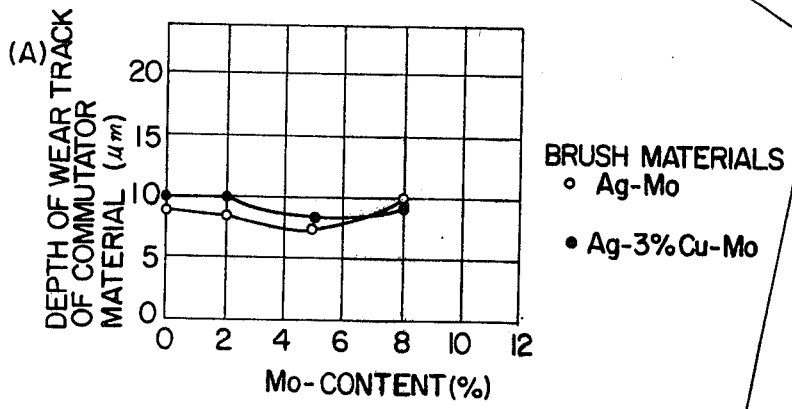
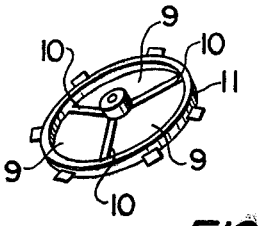
FIG. 4
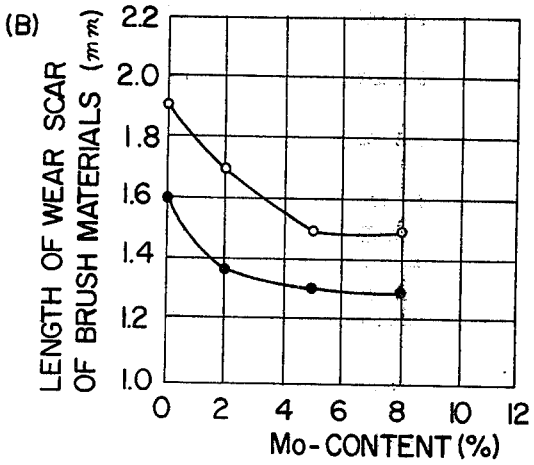
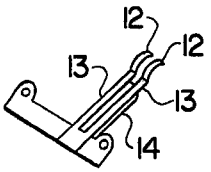
FIG. 5

SILVER ALLOY FOR A SLIDING CONTACT

This invention relates to silver alloy for a sliding contact, and more particularly to sliding contact which is suitable for use as a brush material in a small d.c. motor.

Small d.c. motors are often used in tape recorders, phonographs, measuring recorders, toys, etc. The life of this equipment is determined by the life of a small d.c. motor used in them. The life of the small d.c. motor is mainly determined by the brush and commutator. Wear of the sliding contact combination of a brush and a commutator detrimentally affects the life of the small d.c. motor. As wear increases, wow and flutter of rotation increase due to the fluctuation of contact resistance and friction between the brush and the commutator. As a result, it is impossible to maintain good performance of a small d.c. motor for a long period.

Silver and silver-copper alloy containing up to 30% (% refers to weight percent) copper are customarily used as a sliding contact material for a brush. For long life performance, silver-palladium alloy containing from 30% to 40% palladium is used.

Equipment of today requires long life performance, but these ordinarily known sliding contact materials cannot satisfy the requirements. Moreover, recently it has become clear that silver and silver-copper alloy cannot ensure the long life performance at a low temperature about −10° C. and that silver-palladium alloys have themselves high wear resistance at a low temperature but increase wear of mating commutator material.

Therefore, an object of this invention is to provide a sliding contact material which has high wear resistance, low contact resistance and low friction.

Another object of this invention is to provide a sliding contact material which is suitable for use as a brush in a small d.c. motor and which ensures the long life performance thereof.

A further object of this invention is to provide a sliding combination of a brush and a commutator which ensures the long life performance of a small d.c. motor.

These objects are achieved according to this invention by providing a silver alloy containing 2 to 8% of molybdenum.

These and other objects and features of this invention will be apparent upon consideration of the following detailed description taken together with the accompanying drawings, wherein:

FIG. 1 is a side view of the testing apparatus simulating the brushes and a commutator of a small d.c. motor.

FIGS. 2 (A) and (B) are graphic diagrams showing the effect of molybdenum content of silver alloy for a brush material on the amount of wear after 500 hr running at room temperature using the apparatus shown in FIG. 1.

FIG. 3 is a schematic circuit construction of a small d.c. motor used for the test.

FIG. 4 is a side view of commutator construction used in the small d.c. motor tested.

FIG. 5 is a side view of one of the pairing brushes construction used in the small d.c. motor tested.

Figure 6:
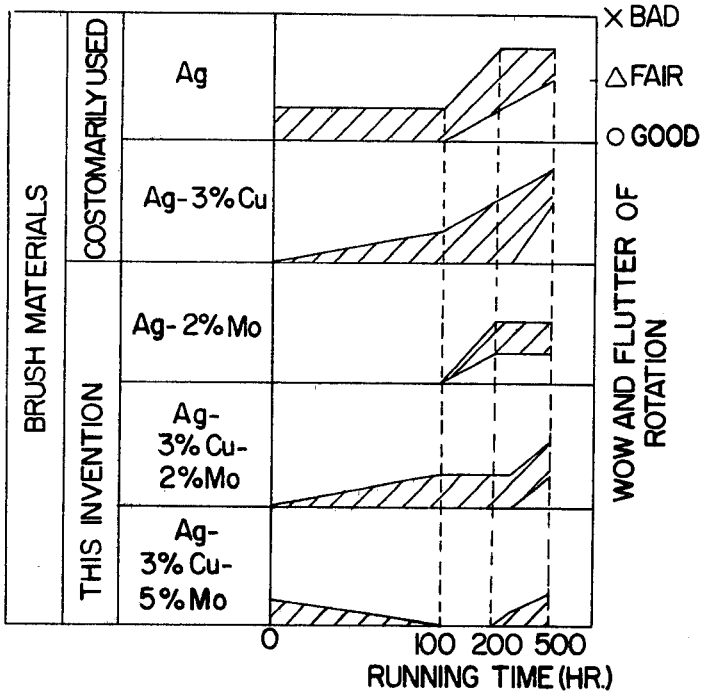
FIG. 6 is a diagram showing variation of wow and flutter of motor rotation vs. motor running time.

The objects of this invention are achieved by using the following silver alloy for brush materials.

Brush material: silver alloy containing 2% to 8% molybdenum, up to 10% copper, up to 10% palladium and remainder silver.

As mating commutator materials, a clad metal composed of surface layer of an alloy 0.5 to 5 μm thick containing 60% to 70% gold, not more than 3% nickel and remainder silver and a layer thereunder of silver alloy containing 3% to 10% copper and remainder silver is useful.

Silver alloy for brush material according to this invention was prepared by ordinary powder metallurgy process. Respective powders of constituent elements, size of 300 mesh or smaller, were mixed together to be homogenized and pressed to form a pellet under pressure of 4.5 ton/cm$^2$ to 10 ton/cm$^2$. Then the pellet was sintered at 800° to 850° C. for 1 to 2 hrs in vacuum to make an alloy. After these processes, the alloy pellet was extruded to form a rod. The rod was then cold-drawn to make a wire of final cross sectional shape of 0.23 mm×0.46 mm semi-round. Annealing for soltening between cold-drawings was performed at 600° C. for 1 hr in a non-oxidizing atmosphere such as nitrogen gas and argon gas. Reduction of the cross sectional area in cold-drawing varied from 5% to 15% per pass. The alloy obtained showed microstructure of molybdenum finely dispersed in the matrix.

Commutator material used in the tests was flat type. Material was prepared by cold-rolling.

One of the apparatus for wear test is shown in FIG. 1. Brush materials 1, 2 mm length, 0.23 mm×0.46 mm cross section and slightly convexed against a flat commutator material 2, were spot-welded at the end of spring sheets 3. Commutator material of 150 μm thick was attached to a rotating disk 4. Contact force of brush to commutator was about 2.5 g. Rotational speed of the disk 4 was 2200 r.p.m. corresponding to linear sliding velocity of about 80 cm/sec. Applied voltage and current through the brush and the commutator were 10 V and 250 mA, respectively.

After testing of 500 hr running at room temperature, the amount of wear was measured. The amount of brush wear was estimated by the length of wear scar at sliding direction, and the amount of commutator wear was estimated by the depth of wear track.

FIG. 2 shows the amount of wear vs molybdenum content of silver alloys for brush. Brush materials used were silver-molybdenum alloy and silver-3% copper-molybdenum alloy. Mating commutator material was a clad metal comprising 70% gold-27% silver-3% nickel alloy surface layer of 1 μm thick, 95% silver-5% copper alloy intermediate layer of 9 μm thick and phosphrous bronze base layer of 140 μm thick.

Apparently from FIG. 2, alloys containing molybdenum show high wear resistance. In the case of more than 2% molybdenum addition, wear of brush markedly descreases as compared with silver and silver-3% copper alloy without molybdenum. At the same time, wear of commutator was also slightly decreased.

To clear another effect of the invention, a test was performed by using small d.c. motors. Schematic circuit construction of such a small d.c. motor is shown in FIG. 3, in which the commutator is built up of segments 5 one per rotor coil 6. These segments 5 are made of commutator material. A pair of brushes 7 contacts commutator segments 5.

The construction of a commutator used in a small d.c. motor is shown in FIG. 4 in which commutator segments 9 are split by slits 10 and carried by plastic mold 11. The thickness of the commutator segment is 150 μm and diameters of sliding tracks are 6 mm and 8 mm. The construction of brush is shown in FIG. 5 in which twin brush materials 12, 2 mm length and 0.23 mm×0.46 mm cross section and slightly convexed against the commutator, are spot-welded at the end of spring sheet 13. Damping rubber 14 is attached to the spring sheet 11.

The small d.c. motor was driven at 12 V, 250 mA with rotating speed of 2200 r.p.m. at room temperature. With this test, fluctuation of contact resistance and friction between the brush and the commutator were detectable. Fluctuation of contact resistance and friction yields wow and flutter of rotation of the small d.c. motor. Wow and flutter of rotation were qualitatively estimated by using a tachometer.

FIG. 6 shows the variation of wow and flutter of rotation vs running time. Wow and flutter of rotation of the small d.c. motor using brush material of this invention showed fair or good after 500 hr running. On the other hand, a small d.c. motor using conventional brush material showed bad rotation. Therefore, it is clear that the brush and commutator combination of this invention has low fluctuation of contact resistance and friction.

To make clear a further effect of this invention, additional testing was performed using a small d.c. motor under more severe conditions of low temperature. It is known that this type of sliding contact shows severe wear at low humidity. Humidity in the atmosphere decreases as temperature decreases. So, the wear of sliding contact increases rapidly at low temperature.

Figure 7:
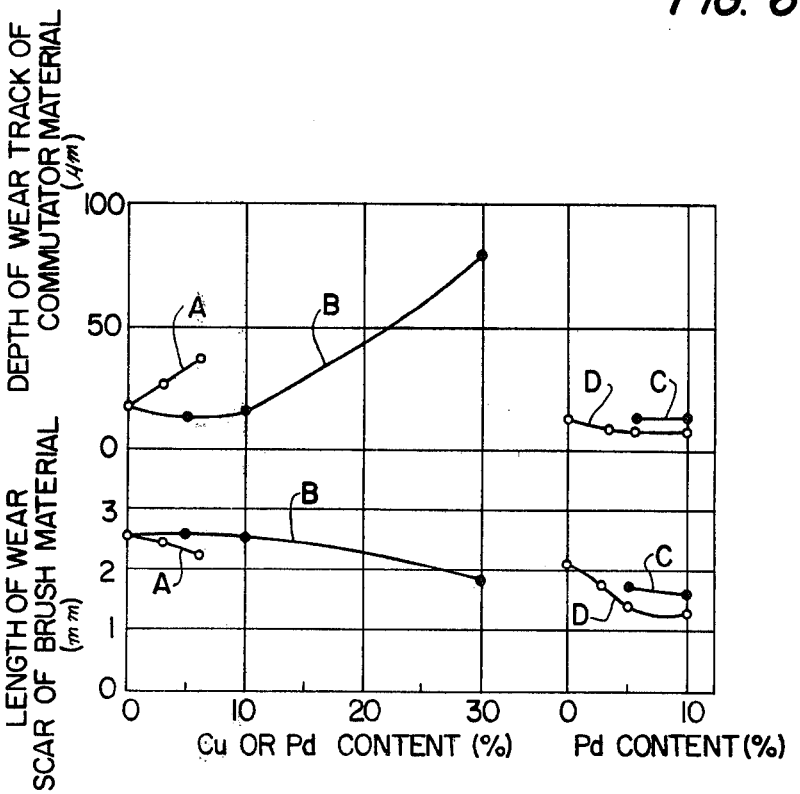
FIG. 7 is a graphic diagram showing the effect of alloying elements of silver alloy for a brush material on the amount of wear after 200 hr running at −10° C. using the small d.c. motor.

The result of running of the small d.c. motor at −10° C. for 200 hr is shown in FIG. 7, in which different brush materials given below were used for comparison.

| curve | brush material | remarks |
|---|---|---|
| A | silver-copper alloy | customarily used materials |
| B | silver-palladium alloy | |
| C | silver - 5% copper - 2% molybdenum - palladium | this invention |
| D | Silver - 3% copper - 4% molybdenum - palladium | |

Mating commutator material was a clad metal comprising 70% gold-27% silver-3% nickel alloy surface layer of 0.9 μm thick, 95% silver-5% copper alloy intermediate layer of 40 μm thick and phosphrous bronze base layer of 109 μm thick.

As compared with silver-copper alloy, brush materials of this invention show high wear resistance for both a brush and a commutator. As compared with silver-palladium alloy, brush materials of this invention show less wear of commutator. By adding palladium to silver-copper-molybdenum alloy, wear of brush is markedly decreased without increase of wear of commutator.

The preferable composition of the silver alloy for sliding contact used as brush material consists essentially of 2% to 8% molybdenum, up to 10% copper, up to 10% palladium and the remainder copper. Addition of molybdenum of at least 2% is effective for decreasing wear of silver and silver-copper alloy as shown in FIG. 2. The upper limit of molybdenum is 8% in view of the workability of the alloy. It becomes difficult to make a wire of an alloy containing more than 8% molybdenum by extrusion and cold-drawing. Copper addition up to 10% is effective for strengthening the alloy. Copper of more than 10% is apt to increase contact resistance. Palladium addition is effective to decrease wear, but it becomes difficult to make a wire of an alloy containing more than 10% palladium.

Mating commutator material used in above-mentioned tests was a clad metal comprizing 70% gold-27% silver-3% nickel alloy surface layer, 95% silver-5% copper alloy intermediate layer and phosphrous bronze base layer. Another clad metal with 60% gold-40% silver alloy surface layer had similar characteristics of wear to those of a clad metal with 70% gold-27% silver-3% nickel alloy surface layer. Therefore, the preferable composition for the surface layer consists of 60% to 70% gold, not more than 3% nickel and the remainder copper. A preferable thickness of the gold alloy surface layer is 0.5 to 5 μm.

The preferable composition for the intermediate layer consists of 90% to 97% silver and 10% to 3% copper in view of mechanical properties and sliding contact characteristics. Preferable thickness of silver-copper alloy intermediate layer is 9 to 40 μm.

The base layer cannot affect the wear characteristics, because the base layer is a backing metal in view of mechanical strength of clad metal.

In view of the above, it will be seen that the several objects of the invention are achieved and other advantageous results attained.

What is claimed is:

1. Silver alloy for sliding contact, containing 2% to 8% molybdenum, 3% to 10% copper, up to 10% palladium and remainder silver.

2. Silver alloy for use as a brush material in a small d.c. motor, containing 2% to 8% molybdenum, 3% copper and remainder silver.

3. Silver alloy for use as a brush material in a small d.c. motor containing 2% molybdenum, 5% copper, 5% to 10% palladium and remainder silver.

4. Silver alloy for use as a brush material in a small d.c. motor containing 4% molybdenum, 3% copper, 2% to 10% palladium and remainder silver.

* * * * *